United States Patent [19]

Yokoyama et al.

[11] Patent Number: 4,863,370

[45] Date of Patent: Sep. 5, 1989

[54] COMBUSTION CHAMBER FOR A PULSE COMBUSTION APPARATUS

[75] Inventors: Nobuyoshi Yokoyama, Toyoake; Tsuneyasu Hayakawa, Kani, both of Japan

[73] Assignee: Paloma Kogyo Kabushiki Kaisha, Japan

[21] Appl. No.: 304,164

[22] Filed: Jan. 31, 1989

[30] Foreign Application Priority Data

Jun. 6, 1988 [JP] Japan ..... 63-139128

[51] Int. Cl.[4] ..... F23C 11/04

[52] U.S. Cl. ..... 431/1; 122/24; 60/39.77

[58] Field of Search ..... 431/1; 122/24; 60/39.76, 39.77, 247; 432/25

[56] References Cited

U.S. PATENT DOCUMENTS

| | | | |
|---|---|---|---|
| 2,900,790 | 8/1959 | Reimers | 60/39.77 |
| 3,606,867 | 9/1971 | Briffa | 122/24 |
| 4,260,361 | 4/1981 | Huber | 431/1 |
| 4,642,046 | 2/1987 | Saito et al. | 431/1 X |
| 4,715,807 | 12/1987 | Yokoyama et al. | 431/1 |

FOREIGN PATENT DOCUMENTS

| | | | |
|---|---|---|---|
| 1039035 | 10/1953 | France | 60/39.77 |
| 55-102804 | 8/1980 | Japan . | |

*Primary Examiner*—Margaret A. Focarino
*Attorney, Agent, or Firm*—Lahive & Cockfield

[57] ABSTRACT

A combustion chamber for a pulse combustion apparatus has a generally circular cross section as viewed from a direction which is perpendicular, in a horizontal plane, to a direction of flow of an air/fuel mixture into the chamber. The chamber includes an inlet from which the air/fuel mixture flows into the chamber and outlet from which burned gas comes out of the chamber. The inlet is located on an upstream side. Also, the inlet is located within an upper half of the foregoing cross section of the chamber as viewed from the foregoing perpendicular direction. The outlet is located at the center of the foregoing cross section of the chamber as viewed from the foregoing perpendicular direction. The outlet has an axial centerline which cuts an axial centerline of the inlet at right angles, as viewed from above or below, if the axial centerline of the outlet is extended inwardly of the chamber while extending the axial centerline of the inlet in a downstream direction. The inlet has a front space and a rear, cylindrical space which communicate with each other. The front space is tapered in the downstream direction and has a termination with a diameter smaller than a diameter of the rear space.

4 Claims, 3 Drawing Sheets

COMBUSTION CHAMBER FOR A PULSE COMBUSTION APPARATUS

FIELD OF THE INVENTION

This invention relates to a combustion chamber for a pulse combustion apparatus.

BACKGROUND OF THE INVENTION

A combustion chamber 1' of the prior-art pulse combustion apparatus is illustrated in FIG. 4. The combustion chamber 1' has a generally-oval vertical cross section as viewed from either of opposed sides thereof, as shown in FIG. 4. The combustion chamber has an inlet 3' and an outlet 4'. The inlet and the outlet are aligned with each other, and have a central space of the chamber 1' between them. A mixing chamber 10' is located on the upstream side of the combustion chamber 1'. The mixing chamber 10' has check valves $V_2$. A flame trap 9 is located between the mixing chamber and the combustion chamber. A gas distributor 15' connects with the mixing chamber. Fuel gas is supplied through the gas distributor 15' into the mixing chamber 10'. Air supplied opens the valves $V_2$ and enters the mixing chamber. The fuel gas and the air are mixed together in the mixing chamber. The fuel/air mixture flows through the flame trap 9, and enters the combustion chamber 10' from its inlet 3'. The mixture is ignited therein. The burned gas comes from the chamber 1' through its outlet 4', and flows through a tail pipe 17'.

Initially the air/fuel mixture supplied into the combustion chamber 1' is ignited in a forced manner, or by a spark plug (not shown in FIG. 4). And, once combustion starts normally in the chamber 1', subsequent air/fuel mixtures supplied into the chamber 1' need not be ignited in a forced manner, but ignite themselves. This "self-ignition" is caused by the possibility that a portion of the burned gas which has flowed into the tail pipe 17' may return into the combustion chamber 1' or by the possibility that a portion of the burned gas may not come from the chamber 1', but may remain therein. Such a portion of the burned gas ignites the subsequent air/fuel mixture.

It is to be noted that the air/fuel mixture prepared in the mixing chamber 10' needs further mixing so as to have a sufficient degree of uniformity of mixture to be normally ignited by the spark plug or to normally ignite itself, in the combustion chamber 1'. However, since, as mentioned above, the inlet 3' and the outlet 4' of the combustion chamber 1' are aligned with each other, it is natural that the mixture supplied into the chamber 1' is disposed to pass straight through the chamber 1' into the tail pipe 17'. Thus, it is possible that the mixture may be hardly mixed in the combustion chamber. Therefore, it is possible that the mixture may not be ignited normally or may not ignite itself normally.

Also, in the prior-art construction of FIG. 4, it is possible that a portion of the burned gas may flow upstream (i.e., in the left-hand direction in FIG. 4) and enter the flame trap 9'. In particular, such a possibility is great when highly ignitable gas, such as city gas, is used. In such a case, that is, if a portion of the burned gas flows upstream into the flame trap 9', it is natural that a subsequent air/fuel mixture may not flow smoothly through the trap 9' into the combustion chamber. It may result in an insufficient amount of air/fuel mixture being supplied into the combustion chamber.

SUMMARY OF THE INVENTION

It is an object of the invention to provide a combustion chamber for a pulse combustion apparatus wherein an air/fuel mixture prepared in a mixing chamber is further mixed so as to have a sufficient degree of uniformity of mixture to be ignited normally by a spark plug or to ignite itself normally.

Another object of the invention is to provide a combustion chamber for a pulse combustion apparatus of the character described above wherein burned gas is not allowed to readily flow upstream, thus allowing a subsequent air/fuel mixture from smoothly entering the chamber.

Still another object of the invention is to provide a combustion chamber for a pulse combustion apparatus of the character described above wherein the discharge of burned gas from the chamber is facilitated.

Other objects and advantages of the invention will become apparent upon reading a detailed description of a preferred embodiment of the invention which will follow.

According to the invention, a combustion chamber for a pulse combustion apparatus has a generally circular cross section as viewed from a direction which is perpendicular, in a horizontal plane, to a direction of flow of an air/fuel mixture into the chamber. The chamber includes an inlet from which the air/fuel mixture flows into the chamber and outlet from which burned gas comes out of the chamber. The inlet is located on an upstream side. Also, the inlet is located within an upper half of the foregoing cross section of the chamber as viewed from the foregoing perpendicular direction. The outlet is located at the center of the foregoing cross section of the chamber as viewed from the foregoing perpendicular direction. The outlet has an axial centerline which cuts an axial centerline of the inlet at right angles, as viewed from above or below, if the axial centerline of the outlet is extended inwardly of the chamber while extending the axial centerline of the inlet in a downstream direction. The inlet has a front space and a rear, cylindrical space which communicate with each other. The front space is tapered in the downstream direction and has a termination with a diameter smaller than a diameter of the rear space.

BRIEF DESCRIPTION OF THE DRAWING

In FIG. 2 an inlet member of the combustion chamber is dismounted from the body of the chamber for clarity of illustration;

DETAILED DESCRIPTION OF A PREFERRED EMBODIMENT

Figure 1:
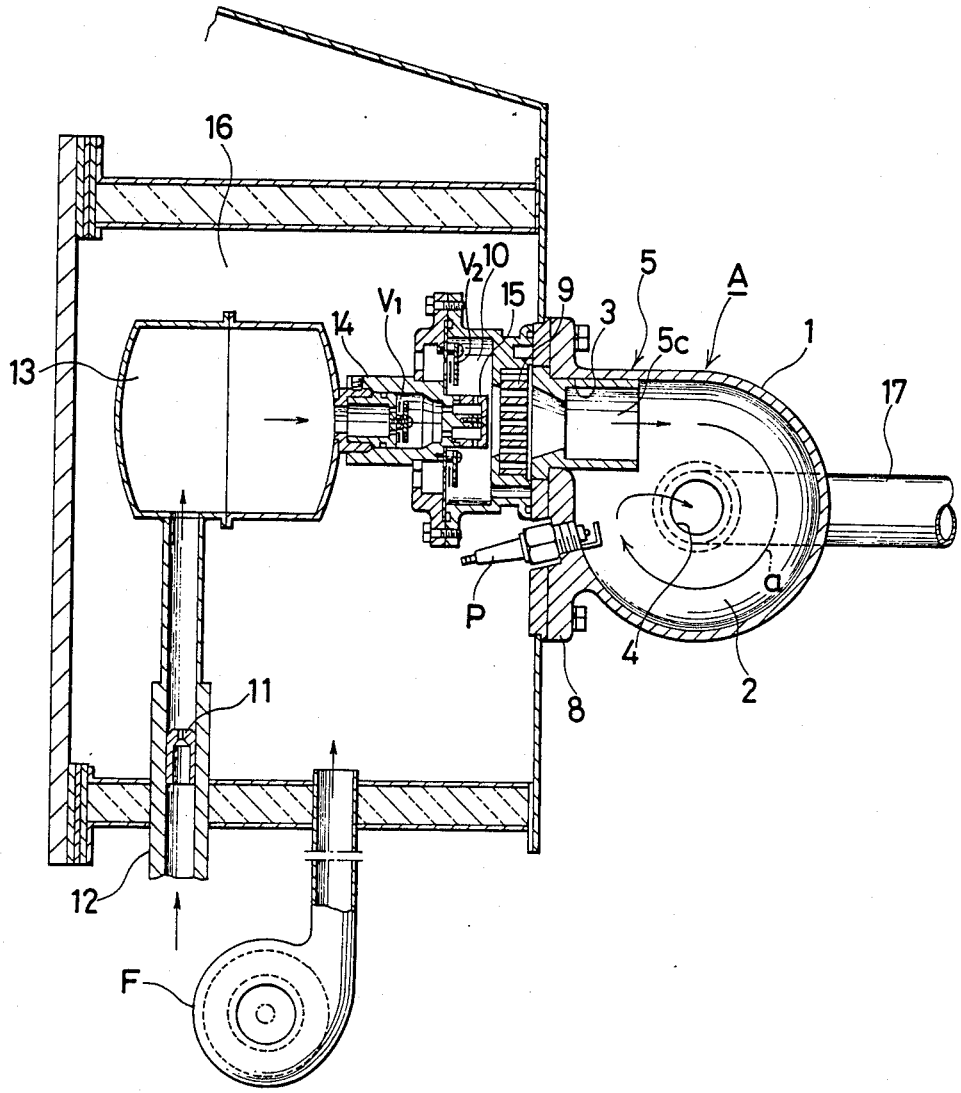
FIG. 1 is a vertical cross section of a pulse combustion apparatus including a combustion chamber according to the invention.
Figure 2:
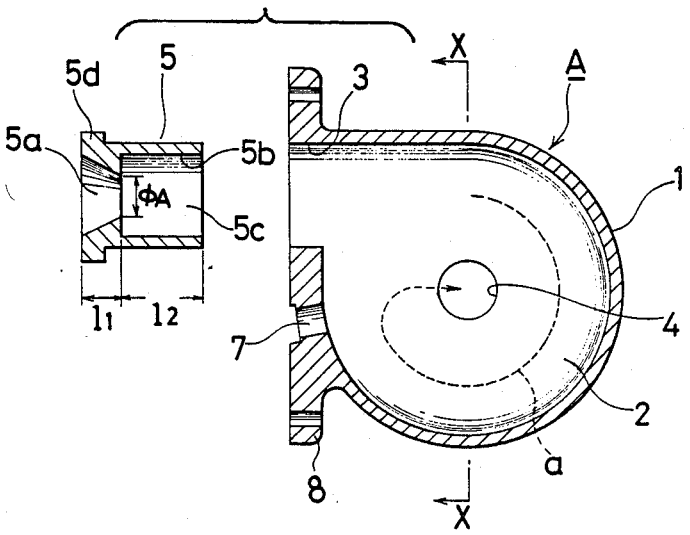
FIG. 2 shows the combustion chamber of FIG. 1.
Figure 3:
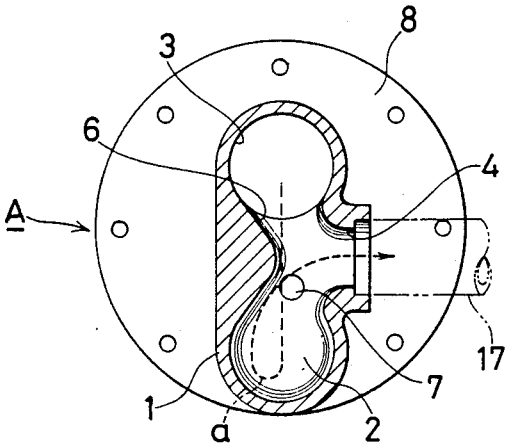
FIG. 3 is a cross section taken on line X—X of FIG. 2.
Figure 4:
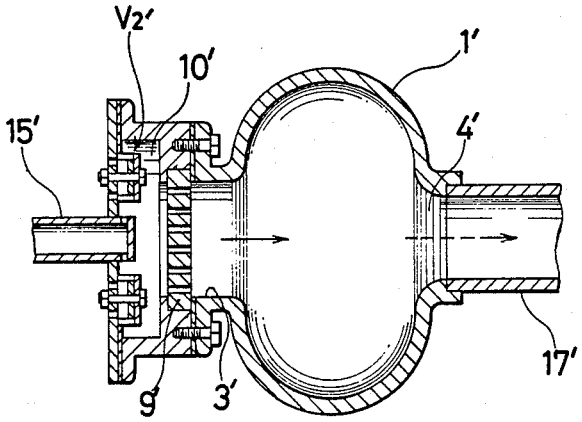
FIG. 4 (PRIOR ART)
FIG. 4 is a vertical cross section of the combustion chamber of the prior-art pulse combustion apparatus.

Referring to FIGS. 1, 2 and 3, a combustion-chamber component A includes a base wall 8 and an enclosing wall 1 which are formed as one body. The component A also includes an inlet member 5 which is formed separately from the walls 8 and 1. The base wall 8 is fixed to a vertical wall. A combustion chamber 2 is defined by the enclosing wall 1. The vertical cross section of the chamber 2 of FIGS. 1 and 2 corresponds to that of the combustion chamber 1' of the prior-art pulse combustion apparatus as shown in FIG. 4. As clearly illustrated, the combustion chamber 1' has a generally oval shape, whereas the combustion chamber 2 of the invention has a generally circular shape. The base 8 has a circular inlet opening 3 which communicates with the chamber 2. As clearly illustrated in FIG. 2, the top of the inlet opening 3 coincides with a left-hand portion of the horizontal line tangent to the vertical, circular cross section of the combustion chamber 2 as illustrated in FIG. 2. The inlet member 5 is disposed through the opening 3.

FIG. 3 is a cross section taken on line X—X of FIG. 2. As clearly illustrated in FIG. 3, the enclosing wall 1 of the combustion-chamber component A has a circular outlet opening 4. One end of a tail pipe 17 is fitted into the outlet opening 4. When the outlet opening 4 is viewed in FIG. 1 or 2, it may be said that the opening 4 is located at the center of the enclosing wall 1. If the centerline of the outlet opening 4 is extended to the left (in FIG. 3) while extending the centerline of the inlet opening 3 to the right (in FIG. 1 or 2), the two centerlines meet at right angles as viewed from above or below. Thus, it may be said that the inlet opening 3 and the outlet opening 4 have a perpendicular positional relationship with each other.

The portion 6 of the enclosing wall 1 which is directly opposed to the outlet opening 4 is bulged toward the opening 4 (FIG. 3).

The base wall 8 also has an opening 7 below the inlet opening 3. A spark plug P (FIG. 1) is inserted through the opening 7.

As mentioned before, the inlet member 5 is disposed through the inlet opening 3 (FIG. 1). In FIG. 2 the inlet member 5 is dismounted from the other portion of the component A for clarity of illustration. As illustrated in FIG. 2, the inlet member 5 has a front space 5*a* and a rear space 5*c* which communicate with each other. The front space 5*a* has a circular cross section, but is tapered toward the rear space 5*c*. The rear space 5*c* is a cylindrical space defined by a cylindrical wall 5*b*. As clearly illustrated, the rear space 5*c* has a diameter which is substantially greater than the diameter $\phi$A of the rear end of the front space. The front space and the rear space serve as an inlet of the combustion chamber 2. Numeral 5*d* designates a flange portion of the inlet member 5.

A flame trap 9 is located on the upstream side of the inlet member 5. A mixing chamber 10 is located on the upstream side of the flame trap 9.

Fuel gas is introduced through a conduit 12 having a nozzle 11, and enters a gas chamber 13. From the chamber 13, the fuel flows through a check valve $V_1$ into a gas distributor 15. From the distributor 15, the gas is supplied into the mixing chamber 10. On the other hand, air is blown from a blower F into an air chamber 16. The air from the chamber 16 opens a check valve $V_2$ and enters the mixing chamber 10. Thus the gas and the air are mixed in the chamber 10.

Preferably disc-type vibrating valves are employed as the check valves $V_1$ and $V_2$.

The air/fuel mixture prepared in the mixing chamber 10 flows through the flame trap 9, and enters the combustion chamber 2 from its inlet (5*a* and 5*c*). Since the front space 5*a* of the inlet member 5 is tapered in a downstream direction, the mixture smoothly enters the chamber 2. Also, since, as mentioned, the diameter of the rear space 5*c* of the member 5 is substantially greater than the diameter $\phi$A of the rear end of the front space 5*a*, the mixture is stirred when passing through the rear space 5*c*. In other words, when the mixture has entered the rear space 5*c*, the mixture becomes a kind of turbulent flow. Thus the mixture is further mixed when passing through the rear space 5*c*. Experiments conducted by the inventors have shown that, if the diameter of the rear space 5*c* is approximately twice the diameter $\phi$A, not only the mixture may flow very smoothly through the inlet member 5 into the chamber 2, but also burned gas may be prevented very effectively from readily flowing back through the inlet member 5. When the mixture has flowed the inlet (5*a* and 5*c*), the mixture starts to go round along the enclosing wall 1 as indicated by an arrow of FIG. 1 or 2. And, initially, when the mixture has come near to the spark plug P, the mixture is ignited by the plug P.

If, as with the prior construction of FIG. 4, the combustion chamber 2 had its outlet right opposite to its inlet (5*a* and 5*b*), the mixture would be hardly mixed in the chamber 2 since the mixture would be disposed to flow straight toward the outlet. However, since the outlet 4 of the chamber 2 has a "perpendicular" positional relationship, the mixture has no such disposition, but goes round along the enclosing wall 1 as described above. And, while going round up to a point near to the plug P, the mixture is further mixed so as to have a sufficient degree of uniformity of mixture to be ignited normally by the plug P.

It is to be noted that after coming from the mixing chamber 10, the mixture is mixed twice. That is, the mixture from the chamber 10 is first mixed when passing through the rear space 5*c* of the inlet member 5 and then is mixed when going round along the wall 1. This feature distinguishes sharply the combustion chamber 2 of the invention from the prior-art combustion chamber 1' of FIG. 4 where the mixture from the mixing chamber is hardly mixed.

The mixture burned, or burned gas, flows toward the outlet 4. It will be appreciated that the flowing of the mixture toward the outlet 4 is facilitated by the bulge 6. However, experiments conducted by the inventors have shown that, even if the left side (in FIG. 3) of the enclosing wall 1 is formed flat, the greater part of the burned gas will certainly flow toward the outlet 4 thanks to the presence of the inlet member 5. The burned gas flows through the outlet 4 into the tail pipe 17.

If a portion of the burned gas does not flow directly toward the outlet 4, but enters the rear space 5*c* of the inlet member 5, such a portion of the gas is not allowed to readily flow back into the front space 5*a* since the diameter $\phi$A of the rear end of the front space 5*a* is substantially smaller than the diameter of the rear space 5*c*. Therefore, a subsequent air/fuel mixture is allowed to smoothly enter the chamber 2.

The axial dimension $l_1$ of the wall defining the tapered, front space 5*a*, the axial dimension $l_2$ of the cylindrical wall 5*b* defining the cylindrical, rear space 5*c* and the diameter $\phi$A of the rear end of the front space 5*a* may be selected to obtain a desired rate at which the fuel/air mixture flows through the inlet member 5.

As is well known in the art, once combustion starts normally in the chamber 2, subsequent air and fuel gas are drawn through the mixing chamber 10 automatically, or by a negative pressure which is created, within the chamber 2, by the combustion products produced therein and flowing into the tail pipe 17. Also, once combustion starts normally, the subsequent mixture need not be ignited by the spark plug P, but ignite itself.

It is to be noted that, since the burned gas is substantially prevented from flowing back through the inlet member 5, a danger of carbon monoxide being produced is substantially eliminated.

What is claimed is:

1. A combustion chamber for a pulse combustion apparatus, comprising (i) a combustion chamber proper having a circular cross section as viewed from a direction which is perpendicular, at a horizontal plane, to a direction of flow of an air/fuel mixture into the chamber, (ii) an inlet opening located on an upstream side of the chamber within an upper half thereof and communicating with said combustion chamber proper, (iii) said inlet opening having a top which coincides with an upstream-side portion of a horizontal line tangent to said circular cross section of said combustion chamber proper, (iv) a hollow inlet member disposed through said inlet opening, (v) said combustion chamber proper having an outlet from which burned gas comes out of the chamber, (vi) said outlet being located at a center of said circular cross section of said combustion chamber proper, and (vii) said outlet having an axial centerline which cuts an axial centerline of said inlet member at right angles, as viewed from above or below, if said axial centerline of said outlet is extended inwardly of said combustion chamber proper while extending said axial centerline of said inlet member in a downstream direction.

2. A combustion chamber in accordance with claim 1 wherein said inlet member has a front space and a rear, cylindrical space which communicate with each other, said front space being tapered in said downstream direction and having a termination with a diameter smaller than a diameter of said rear space.

3. A combustion chamber in accordance with claim 1 wherein said combustion chamber proper is depressed toward said outlet thereof at a portion thereof directly opposed to said outlet.

4. A combustion chamber in accordance with claim 2 wherein said combustion chamber proper is depressed toward said outlet thereof at a portion thereof directly opposed to said outlet.

* * * * *